US008246251B1

(12) United States Patent
Gardner

(10) Patent No.: US 8,246,251 B1
(45) Date of Patent: Aug. 21, 2012

(54) THRUST BOX AND SKID FOR A HORIZONTALLY MOUNTED SUBMERSIBLE PUMP

(75) Inventor: James Gardner, Tulsa, OK (US)

(73) Assignee: Hoss LLC, Tulsa, OK (US)

( * ) Notice: Subject to any disclaimer, the term of this patent is extended or adjusted under 35 U.S.C. 154(b) by 1097 days.

(21) Appl. No.: 11/633,927

(22) Filed: Dec. 5, 2006

(51) Int. Cl.
*F16C 19/30* (2006.01)

(52) U.S. Cl. ..... 384/420

(58) Field of Classification Search ..... 384/95, 384/126, 127, 303, 368, 420, 313, 476
See application file for complete search history.

(56) References Cited

U.S. PATENT DOCUMENTS

| | | | | |
|---|---|---|---|---|
| 3,786,901 | A * | 1/1974 | Randell | 384/415 |
| 4,669,961 | A | 6/1987 | Lorett | |
| 4,890,539 | A | 1/1990 | Eickmann | |
| 4,945,995 | A | 8/1990 | Tholance et al. | |
| 5,364,234 | A | 11/1994 | Eickmann | |
| 5,667,314 | A | 9/1997 | Limanowka et al. | |
| 5,741,116 | A * | 4/1998 | Hudson | 415/104 |
| 5,863,133 | A * | 1/1999 | New | 384/114 |
| 5,951,248 | A | 9/1999 | Hall | |
| 5,957,656 | A | 9/1999 | DeLong | |
| 6,167,965 | B1 | 1/2001 | Bearden et al. | |
| 6,388,353 | B1 | 5/2002 | Liu et al. | |
| 6,450,782 | B1 | 9/2002 | Sakamoto | |
| 6,651,740 | B2 | 11/2003 | Kobylinski et al. | |
| 6,779,608 | B2 | 8/2004 | Grubb et al. | |
| 7,104,766 | B2 * | 9/2006 | Mascola | 384/606 |
| 2004/0057642 | A1 * | 3/2004 | New | 384/122 |

* cited by examiner

*Primary Examiner* — Thomas R Hannon
(74) *Attorney, Agent, or Firm* — Gable Gotwals

(57) ABSTRACT

A thrust chamber using a single thrust bearing and having seals secured to the thrust chamber case. Also a skid for a horizontally mounted submersible pump, thrust chamber and drive mechanism. The skid having a thrust chamber mounting bracket which provides positive mounting locations thus allowing for the change out of the thrust chamber without removing the drive mechanism.

6 Claims, 7 Drawing Sheets

THRUST BOX AND SKID FOR A HORIZONTALLY MOUNTED SUBMERSIBLE PUMP

FIELD OF THE INVENTION

The present invention relates generally to horizontally mounted submersible pumps. More specifically, the present invention relates to thrust box and their use in conjunction with a horizontally mounted submersible pump.

BACKGROUND OF THE INVENTION

Submersible pumps like the kind used in oil fields are designed for downhole applications. They typically have a cylindrical shape with a diameter that allows them to be inserted within the casing of the well. The length of the pump can vary from 20 feet to 80 feet or more depending upon the amount of pressure and volume necessary for the application. These submersible pumps have the capability of pumping extremely large volumes of fluid in a very short time. Because of their ability to pump large volumes of fluid very rapidly, there are many surface applications for these submersible pumps. In order to use the pumps on the surface it is necessary to mount the pump horizontally on a skid. The pump can then be powered with a standard combustion engine or electric motor depending upon the utilities available at the application site.

In using the submersible pumps a great amount of thrust is generated by the force of the fluid flowing through the pump. Because of this force, it is necessary to have a thrust box between the pump and the electric motor. The drive shaft of the electric motor is coupled to the drive shaft of the thrust box. The opposite end of the thrust box drive shaft is coupled to the submersible pump. The thrust box is designed to absorb the thrust generated by the pump and transfer it back to the pump housing. This prevents the thrust generated by the pump from being absorbed by the combustion engine or electric motor driving pump. If the combustion engine or electric motor were coupled directly to the submersible pump this force would quickly destroy the bearings of the engine or motor.

There currently are many thrust boxes on the market, however, there are several shortcomings in their design. First, the thrust boxes on the market do not have a circulated and cooled lubricant. This creates problems with heat build up and lubricant failure which greatly shortens the life of the thrust box. Second, the thrust boxes rely upon seals which are held in place by clip rings mounted in grooves in the shaft. The groove cut in the shaft can introduce stress cracks in the shaft.

If the submersible pump, thrust chamber and motor are moved from one job site to another it often requires that the pump be operated at a different pressure. Because of the different pressure, different seals must be used to seal both the inlet end of the pump and the case of the thrust chamber. The various seals have different lengths. The distance between the grooves in the shaft and the case of the thrust box must vary to accommodate the length of the new seal. This in turn means that for different applications a different shaft must be used. This leads to a large number of different shafts which could possibly be used with a submersible pump and thrust box system. The operator or manufacturer must either stock these various shafts or have them custom made for each application. Because of the cost of maintaining inventory, most manufacturers custom make these shafts per the operator's specification. This creates increased down time and loss of operating revenue for the operator if they must change out the shaft and/or thrust box due to relocating the equipment or mechanical failure of the equipment.

A further draw back to the prior art horizontally mounted submersible pump systems is that the skid is manufactured such that the electric motor or pump must be removed from the skid in order to remove the thrust box. The thrust box is typically the component most likely to fail. When the electric motor or engine is removed from the skid it must be realigned along with the thrust box in order to reinstall the thrust box and motor. This too leads to increased down time and loss of operating revenue for the operator.

BRIEF SUMMARY OF THE INVENTION

Due to the shortcomings of the prior art thrust boxes and skid mounted horizontally submersible pump systems, the Applicant has come up with an improved thrust box and horizontally mounted submersible pump skid. The thrust box utilizes seals which are mounted directly to the casing. Thus reducing possible stress and fracture related problems associated with cutting grooves into the shaft. The improved thrust box also utilizes a completely flooded case interior for holding lubricant. The lubricant is pumped out of the case and through an oil filter and a heat exchanger to remove excess heat. This greatly increases the service life of the thrust box. The longevity of the seals is also aided by the fact that the lubricant is removed from the case under a vacuum pressure rather than being forced under positive pressure through the case.

The skid is also manufactured such that the thrust box can be removed from the skid without first removing the pump and/or electric motor or combustion engine.

The improved thrust box also utilizes equalizing thrust bearings to transfer the force of the thrust from the shaft to the case of the thrust box and then back into the pump. The use of thrust bearings greatly reduces the number of bearings necessary over using angle needled bearings. The thrust bearings also allow the thrust box to operate both clockwise and counterclockwise without having to change out bearings as would be necessary with using angled needle bearings.

The thrust bearing can be equipped with a heat sensor. This allows the monitoring of the internal temperature of the thrust bearing and not just the temperature of the lubricant thus providing indication as to maintenance problems before there is a catastrophic failure. Likewise the thrust bearing can be equipped with a load sensor. Changes of the load on the thrust bearing can provide the operator an indication of the condition of the pump.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
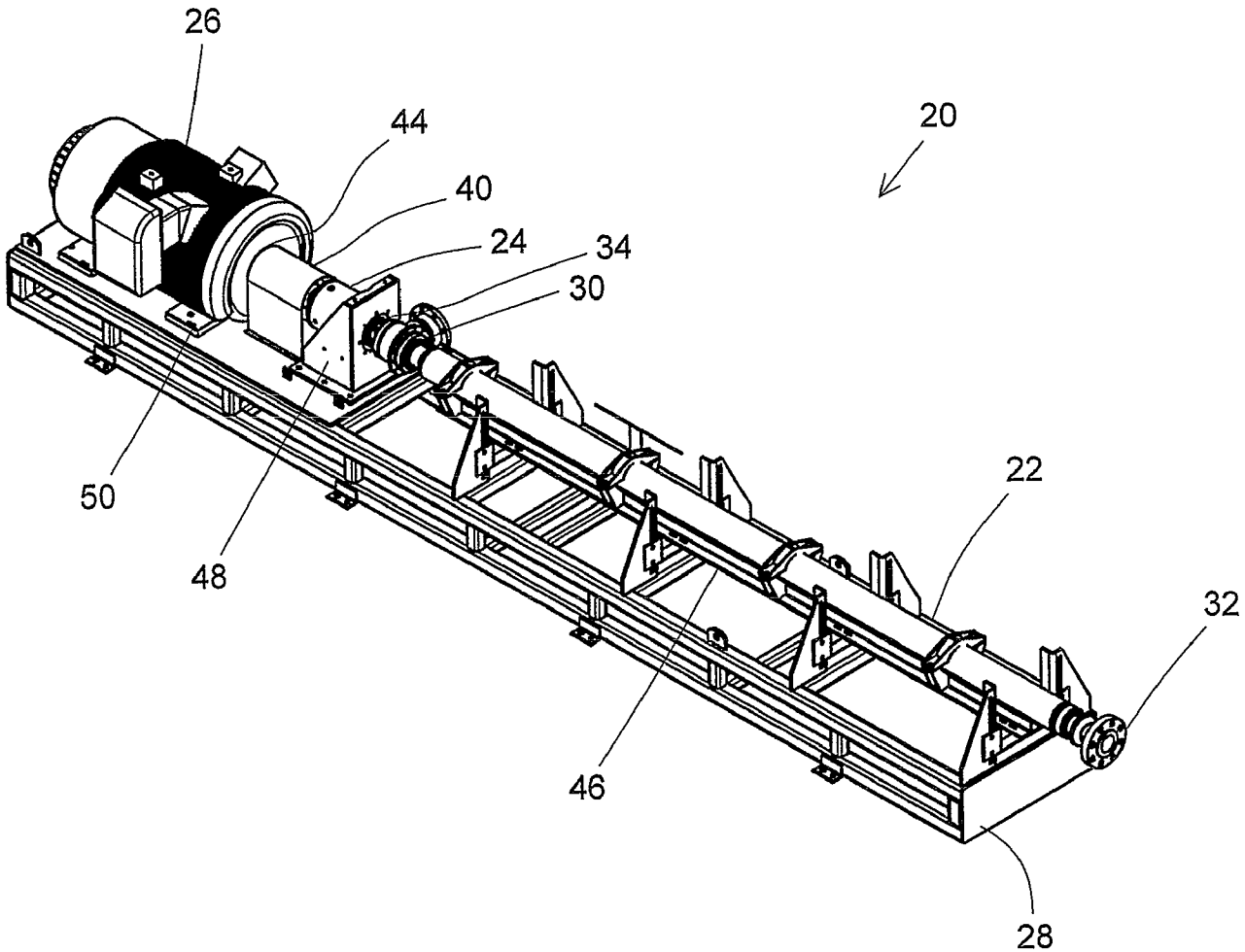
FIG. 1 is a perspective view of a skid mounted horizontal submersible pump thrust box and motor in accordance with the present invention.

Turning now to the drawings wherein like reference characters indicate like or similar parts throughout, FIG. 1 shows a skid mounted submersible pump which has four main components, the submersible pump 22, the thrust chamber 24, the motor 26 and the skid 28. The pump 22 has an inlet 30 and an outlet 32. A first coupler 34 connects the pump shaft 36 to the first end of the thrust chamber shaft. A second coupler 40 connects the second end 42 of the thrust chamber shaft to the shaft 44 of the motor 26.

FIG. 1 shows the skid mounted horizontal submersible pump with an electric motor 26. Other drive mechanisms including but not limited to an internal combustion engine or hydraulic motor could also be used to power the horizontal submersible pump 22.

The skid 28 has a cradle 46 which supports the pump 22. A thrust chamber mounting bracket 48 holds the thrust chamber 24 in place. The skid 28 also has the motor mounting brackets 50 which hold the motor 26 in place.

When in use the water or other fluid enters the pump 22 through inlet 30 and is forced out the outlet 32. The water leaving the outlet 32 creates a tremendous amount of force or thrust directed toward the thrust box 24 and motor 26. The shaft of the pump 22 pushes against the first end 38 of the thrust chamber shaft. This force is transferred from the thrust chamber 24 through the thrust chamber mounting bracket 48, into the skid 28 and into a skid 28 foundation (not shown).

Figure 2:
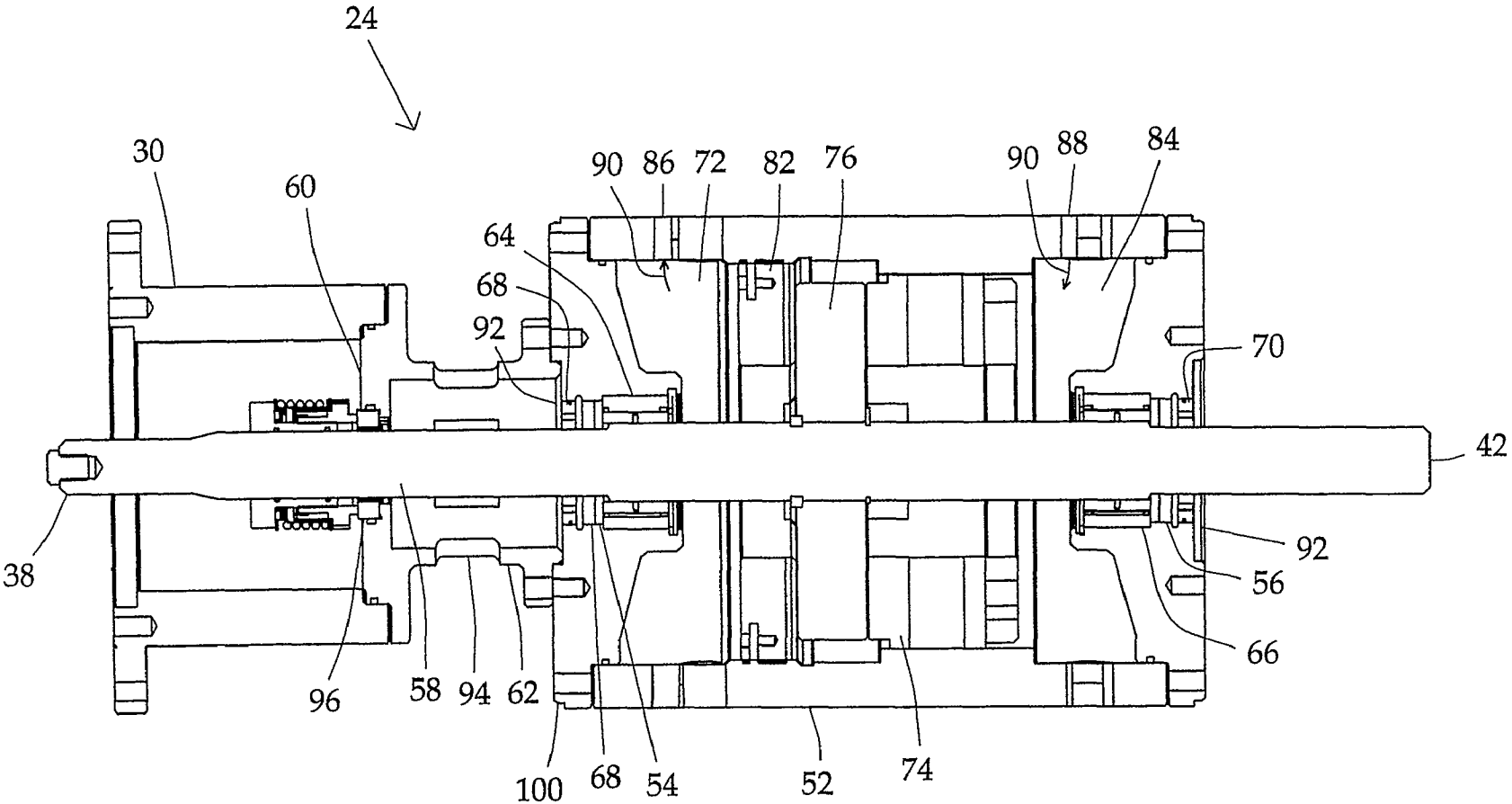
FIG. 2 is a cross-sectional view of the thrust box and pump inlet taken along the line 2-2 indicated in FIG. 1.

FIG. 2 shows a cross-section of the thrust chamber 24 and the pump inlet 30. The thrust chamber 24 has a case 52, a first passageway 54 and an opposing second passageway 56. The shaft 58 passes through the passageways 54 and 56 and extends into the inlet 30 of the pump 22 through a passageway 60. A spool 62 is located between the pump inlet 30 and the thrust box 24 to help maintain alignment and transfer some of the force of the thrust. The thrust chamber shaft 58 is supported in the case 52 by a first and second bearing 64 and 66.

FIG. 1 shows the first and second bearing 64 and 66 as being needle or roller bearings, however other types of bearing including but not limited to ball bearings could be used. A first and second seal 68 and 70 are located in the first and second passageways 54 and 56. The seals 68 and 70 provide a seal between the shaft 58 and the case 52. This keeps lubricant 72 in the case 52. The thrust bearing 74 is mounted to the case 52. It is preferred to use a self equalizing thrust bearing however other types of bearings can be used.

Figure 3:
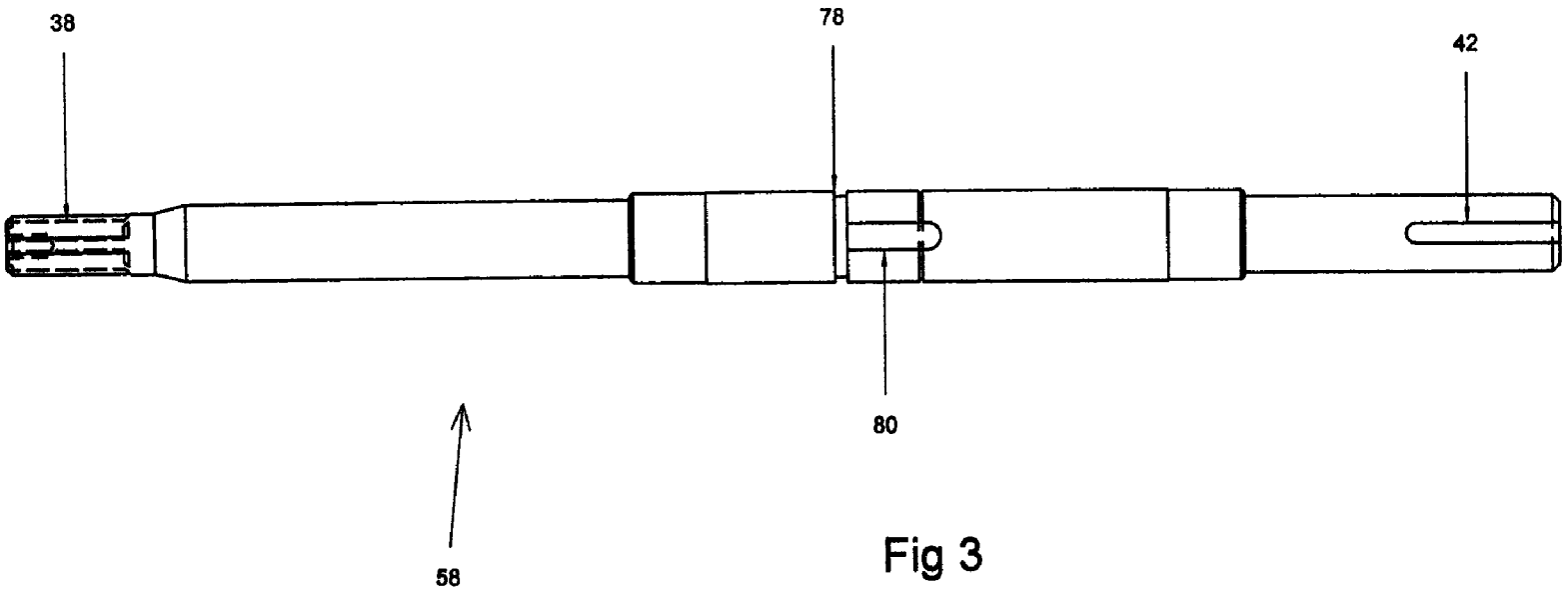
FIG. 3 is a side view of the shaft of the thrust box.

A thrust runner 76 is secured to the shaft 58 by a radial groove 78 and a keyway 80 (see FIG. 3). The force generated by the pump 22 is transferred through the shaft 58 and the thrust runner 76 into the thrust bearing 74.

On certain occasions such as if the pump is reversed the force can be in the opposite direction. In these situations the force is transferred from the shaft 58 through the thrust runner 76 and into the up thrust ring 82. The up thrust ring 82 is secured to the case 52.

The lubricant 72 is removed from the interior 84 of the case under vacuum by a pump 104 through the lubricant outlet 86. The lubricant is then run through a heat exchanger 106 where the heat is removed. The lubricant 72 is reintroduced into the interior 84 of the case 52 via a lubricant inlet 88. The flow of the lubricant through the interior 84 of the case 52 is indicated by the arrows 90. The seals 70 are each held in place by collars 92 which are secured to the case 52. It is preferred to maintain the interior 84 of the case 52 such that it is completely flooded with lubricant 72. This ensures all moving internal parts are lubricated and cooled.

Figure 7:
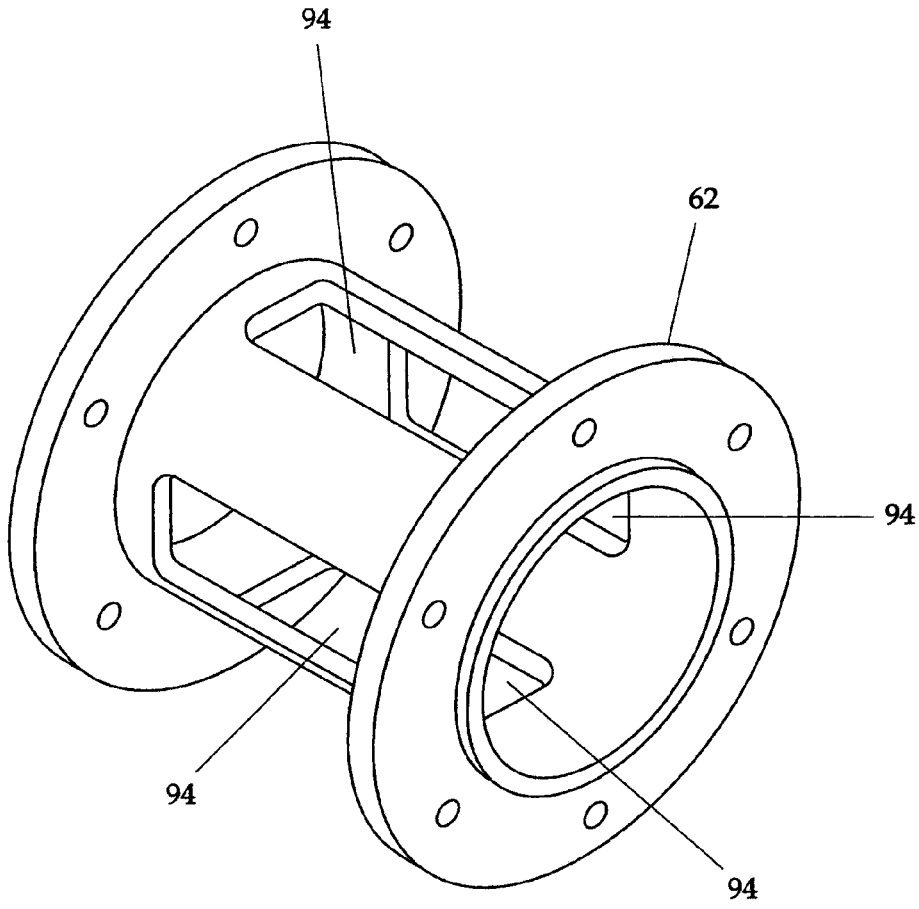
FIG. 7 is a perspective view of the spool located between the thrust chamber and submersible pump inlet.
Figure 8:
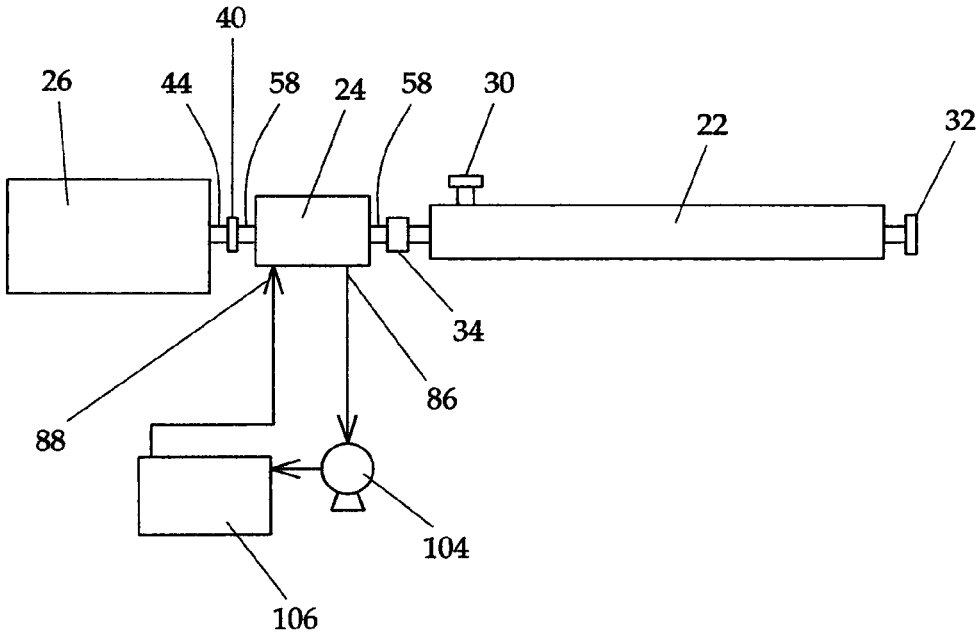
FIG. 8 is a schematic of the present invention.

The spool 62 located between the thrust chamber 24 and the pump 22 has one or more openings 94 (see FIG. 7). In the event the seal 96 of the pump inlet fails any liquid which passes along next to the shaft 58 will enter the spool 62 and pass through one or more of these openings 94 thus eliminating the possibility of this liquid being forced passed the thrust chamber seal 68 and into the interior 84 of the case 52.

Figure 5:
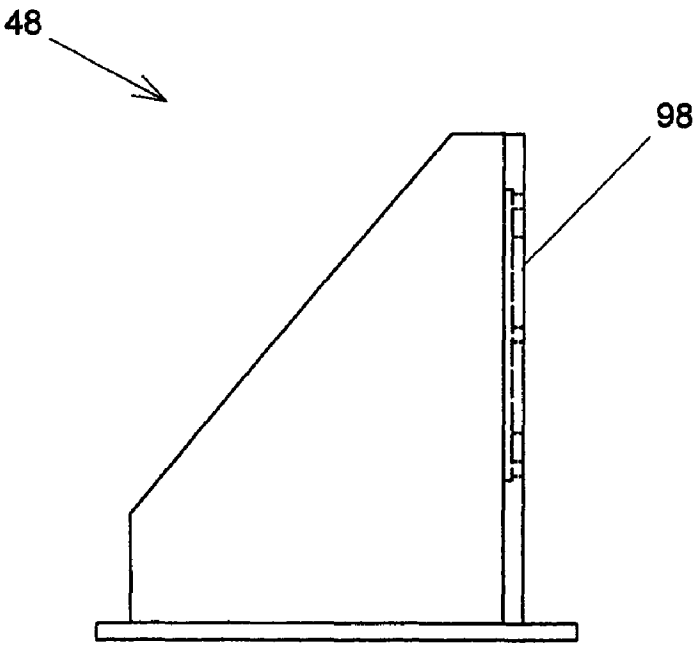
FIG. 5 is a side view of the thrust chamber mounting bracket.
Figure 4:
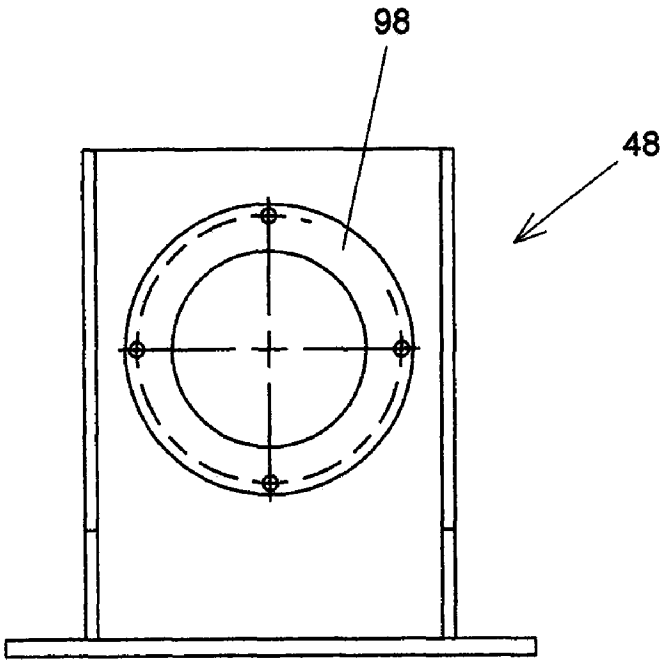
FIG. 4 is a back view of the thrust box mounting bracket.
Figure 6:
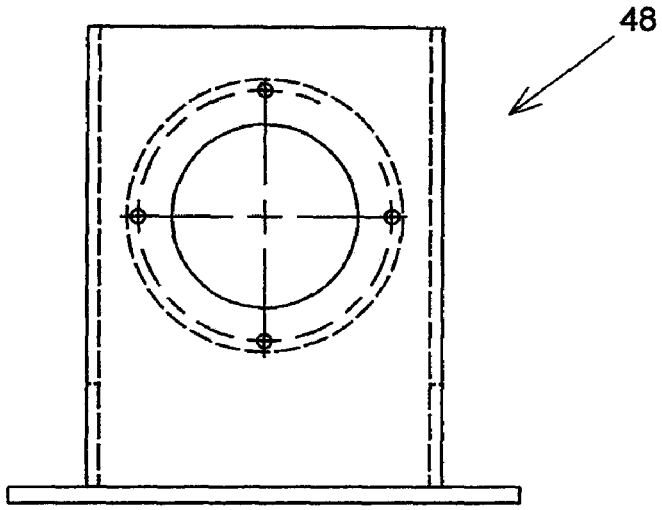
FIG. 6 is a front view of the thrust chamber mounting bracket.

Turning to FIGS. 4, 5 and 6, the thrust chamber mounting bracket 48 is secured to the skid 28. The bracket 48 has a machine surface 98 which is complimentary to the machined surface 100 on the case 52 of the thrust chamber 24. When setting up the skid 28 the submersible pump 22 is first positioned in the cradle 46 and secured in its position. The thrust chamber mounting bracket 48 can then be located on the skid such that the thrust chamber 24 mounted on the bracket 48 is in alignment with the submersible pump 22. Once aligned the mounting bracket 48 is secured to the skid. The motor 26 or other drive mechanism can then be aligned such that the shaft of the drive mechanism is aligned with the thrust chamber, shaft 58 and the shaft 36 of the pump 22. Because the machine surface 98 of the pump mounting bracket 48 positively engages the machine surface 100 of the thrust chamber case 52, it ensures that the thrust chamber 24 can be removed from the bracket 48 and then remounted and still remain in alignment with the pump 22 and the motor 26.

Often times the thrust chamber 24 fails before the pump 22 or motor 26. The prior art skid designs require that the motor or drive mechanism be removed when removing the thrust chamber. This requires that both the new replacement thrust chamber and the drive mechanism be aligned with the pump shaft thus increasing the amount of labor and down time necessary to change out a thrust chamber.

With the present design, however, the motor 26 or other drive mechanism remains in place when removing the thrust chamber thus greatly reducing the amount of down time and labor necessary to change out the thrust chamber 24. Also because of this positive location of the thrust chamber 24. The replacement thrust chamber 24 will already be aligned with both the pump 22 and the motor 26.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A thrust box comprising:

a case having an interior, and a first passageway and an opposing second passageway;

a shaft passing through the case and the first and second passageway;

a first and second bearing located inside the case and holding the shaft in alignment relative to the case;

a first seal secured to the case by a first collar and providing a seal between the first passageway and the shaft;

a second seal secured to the case by a second collar and providing a seal between the second passageway and the shaft;

a thrust bearing mounted in the interior of the case;

an upthrust ring secured to the shaft and engaging the thrust bearing.

2. The thrust box of claim 1, further comprising the interior being completely flooded with lubricant.

3. The thrust box of claim 2, further comprising the case interior being in fluid communication with a pump and a heat exchanger wherein the lubricant can be pumped under vacuum pressure through the pump and the heat exchanger and back into the case interior.

4. The thrust box of claim 1 further comprising a spool attached to the case; and one or more passageways extending through the spool;

wherein the shaft extends through the spool.

5. The thrust box of claim 1, further comprising the shaft having only a single radial groove, the groove and a keyway securing the thrust runner to the shaft.

6. The thrust box of claim 5, further comprising a pump inlet; and a seal located between the pump inlet and the shaft;

wherein the shaft is smooth-adjacent to the seal.

* * * * *